United States Patent [19]

Peterson et al.

[11] 4,078,669

[45] Mar. 14, 1978

[54] STRIKER ASSEMBLY FOR RAILWAY CAR CUSHIONING DEVICE

[75] Inventors: William H. Peterson, Homewood, Ill.; Eugene I. Varda, Saint John, Ind.

[73] Assignee: Pullman Incorporated, Chicago, Ill.

[21] Appl. No.: 681,947

[22] Filed: Apr. 30, 1976

[51] Int. Cl.[2] ..... B61G 9/20

[52] U.S. Cl. ..... 213/50.5; 213/64

[58] Field of Search ..... 213/12, 18, 62, 64, 213/67, 69, 78, 86, 98, 188, 50.5, 70–72, 66, 50, 51

[56] References Cited

U.S. PATENT DOCUMENTS

| | | | |
|---|---|---|---|
| 1,363,939 | 12/1920 | Washburn | 213/69 |
| 1,542,728 | 6/1925 | Regan et al. | 213/62 R |
| 1,678,141 | 7/1928 | Hoerr | 213/50.5 |
| 1,836,244 | 12/1931 | Haseltine | 213/71 |
| 1,860,539 | 5/1932 | Haseltine | 213/8 |
| 2,477,535 | 7/1949 | Wilson et al. | 213/50.5 |
| 2,531,758 | 11/1950 | Wilson et al. | 213/69 |
| 3,556,311 | 1/1971 | Kinnecom | 213/69 |
| 3,994,402 | 11/1976 | Young | 213/50.5 |

*Primary Examiner*—Robert B. Reeves
*Assistant Examiner*—H. Grant Skaggs
*Attorney, Agent, or Firm*—John A. Doninger

[57] ABSTRACT

A striker assembly for end-of-car hydraulic cushioning devices includes a housing which is connected to the shank of the coupler. The coupler shank is provided with an elongated slot which is connected to a transversely extending key carried in key supporting slots provided in vertical side walls of the housing. The key has a pair of transversely spaced notches which are engaged by vertical retaining pins supported within the housing. One of the retaining pins is movable outwardly from the housing which thereupon permits the key to be removed through one of the key supporting slots whereby the coupler is readily removable.

7 Claims, 4 Drawing Figures

STRIKER ASSEMBLY FOR RAILWAY CAR CUSHIONING DEVICE

BACKGROUND OF THE INVENTION

1. Field of the Invention

This invention relates to the railway art and particularly to end-of-car cushioning devices which are carried in the center sill of the car. Specifically, the field of invention relates to striker assemblies which are connected to the end-of-car cushioning devices and are also connected to the couplers of the railway car.

2. Description of the Prior Art

The prior art relating to striker assemblies and end-of-car cushions disclosed various different constructions for connecting the draft key with respect to the striker housing. The designs for securing the key in place have included plates placed at opposite ends of the key slot liner. One of such plates would be bolted in place by using holes tapped into the striker housing. The other plate would be welded in position. Because of the necessity of replacing the key and the coupler it has been difficult to remove the bolted plate and replace the same particularly if the tapped holes in the striker housing have become damaged. Therefore, repair and replacement has been difficult. Also devices of the prior art by virtue of the limited spacing available in the standard center sill, have made it impossible to provide sufficient bearing area for the draft key at the ends of the key slot liners. The present invention therefore provides for a more effective way of securing the draft key in position and provides a sufficient bearing surface for the same despite the relatively narrow width available in the standard center sill of a railway car employing end-of-car cushioning.

SUMMARY OF THE INVENTION

In the present invention an end-of-car cushioning device is connected to an improved striker assembly consisting of a rectangular housing having at its outer ends flared walls to which a striker plate is secured. The striker plate includes an opening which supports a coupler carrier plate assembly which in turn supports the shank of a coupler projecting inwardly into the housing. The coupler shank is provided with an elongated slot through which an improved type of draft key is inserted. The draft key is supported at its opposite ends on the key slot liners which in turn are supported in key supporting slots provided in vertical walls of the housing. The draft key is of a unique shape in that its rear wall is notched to provide a relatively short length rear wall disposed within the slot of the coupler shank. The notches include arcuate portions which extend and terminate in offset vertical walls extending outwardly to the ends of the draft key. The draft key is retained in the striker housing by means of vertically extending retainer pins. One of the retainer pins is fixed to the key slot liner and engages one of the notches to prevent lateral movement in one direction. Another retainer pin is removably connected to the housing and to the key slot liners in turn engaging the other notch to confine the key in position within the slot of the coupler shank. The latter removable pin is vertically displacable through the upper horizontal wall of the housing whereupon the key end coupler may be readily removed and replaced. This permits ready and quick changeover of coupler keys and couplers and also includes a novel construction which assures longer life as will appear from the specification.

DESCRIPTION OF THE PREFERRED EMBODIMENT

Figure 2:
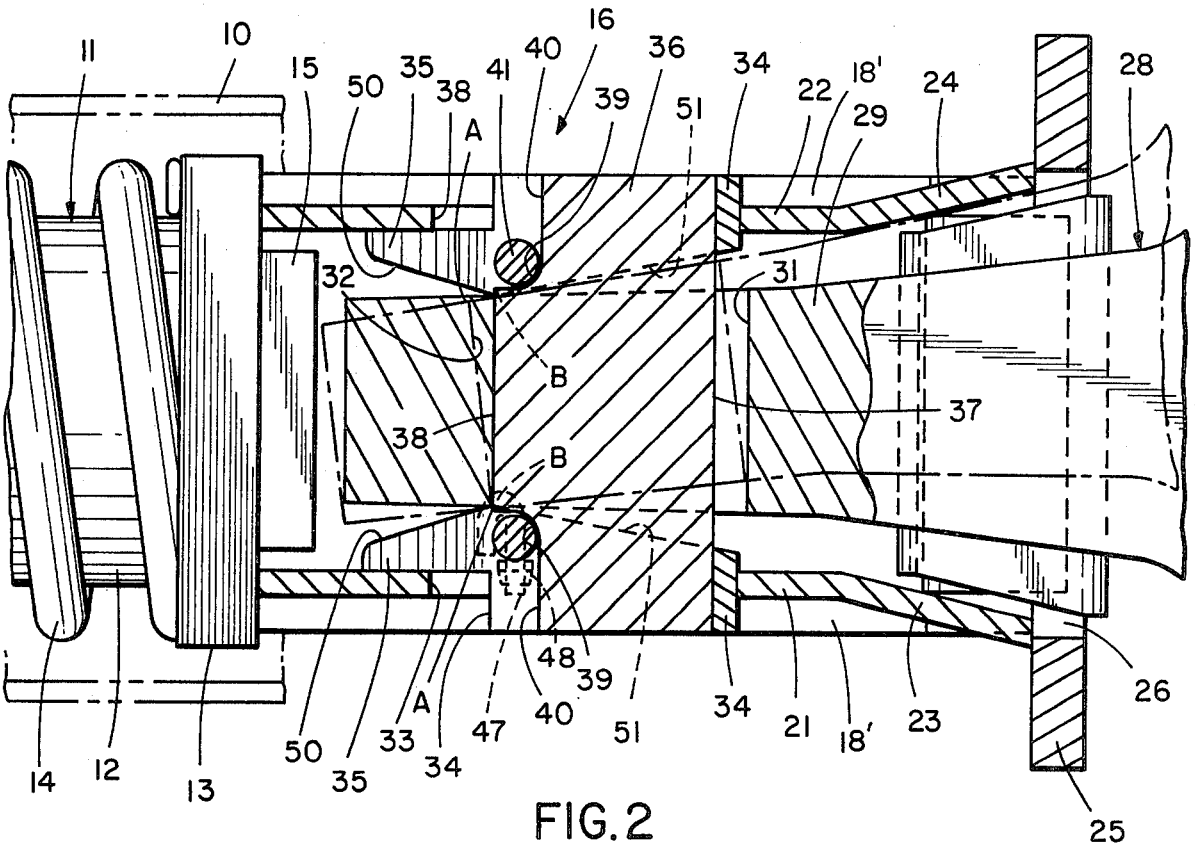
FIG. 2 is a cross sectional view taken substantially along the line 2—2 of FIG. 1.
Figure 3:
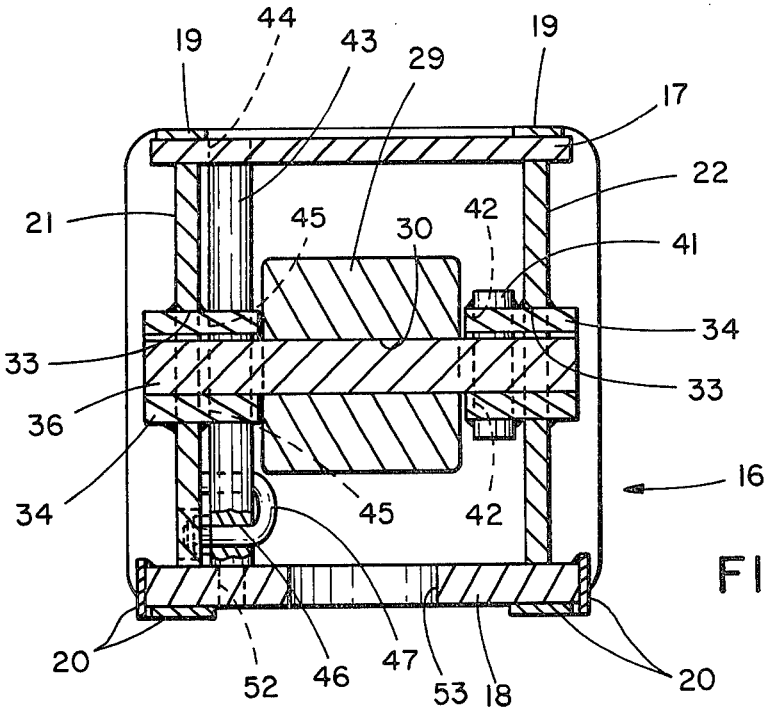
FIG. 3 is a cross-sectional view taken substantially along the line 3—3 of FIG. 1
Figure 4:
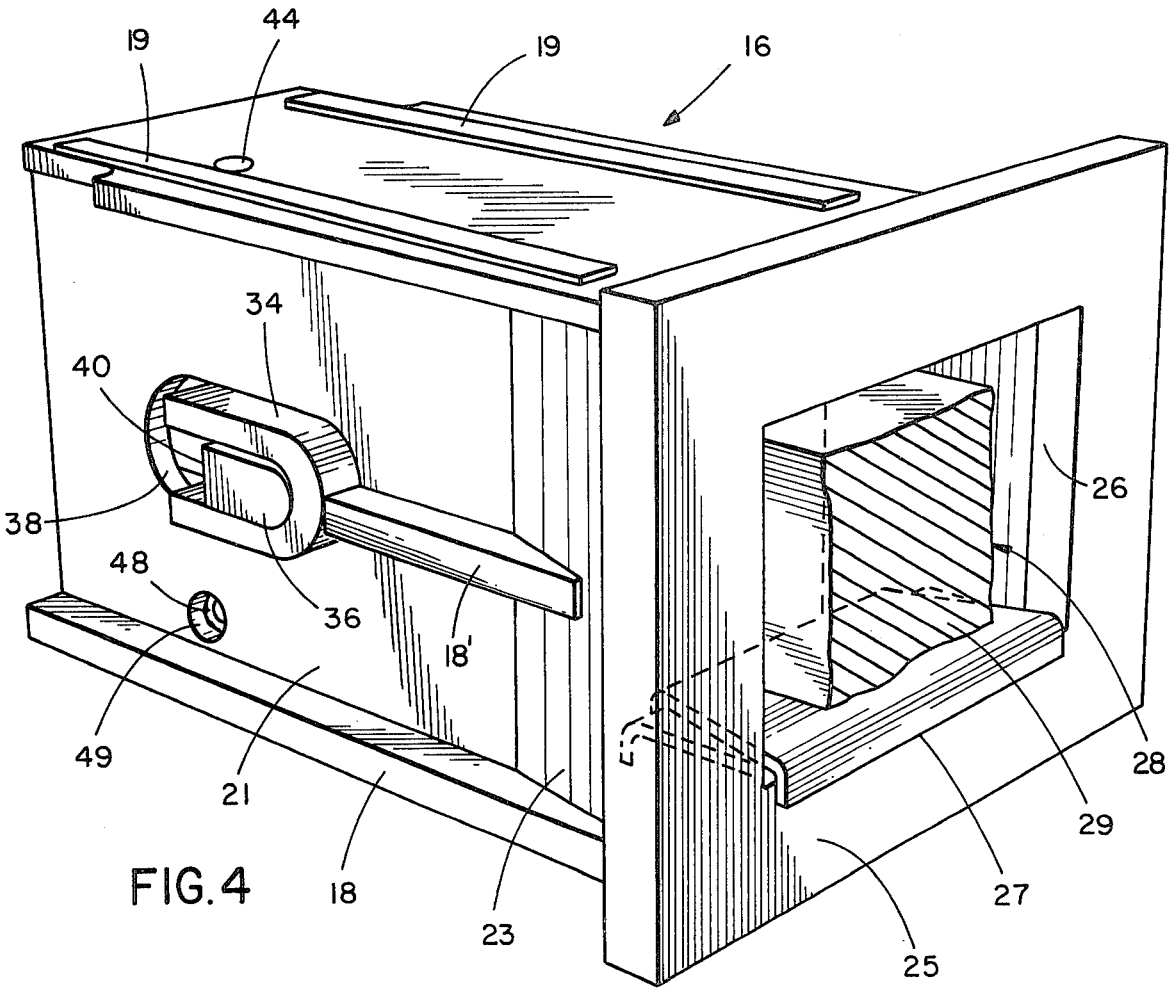
FIG. 4 is a perspective view showing a striker housing having a coupler shank connected thereto.

The present invention is particularly concerned with end-of-car cushioning devices which are well known and conventional in the art. The center sill of the railway car is usually provided at opposite ends with cushions which absorb the end-of-car impacts to which railway equipment is generally subjected. As shown in FIG. 2 a railway car includes a center sill 10 having at opposite ends thereof cushioning units generally designated at 11. Each cushioning unit 11 may comprise a hydraulic cylinder 12 suitably secured at one end (not shown) within the center sill and which is provided at an opposite end with a base plate 13. A return spring assembly 14 is provided for returning the cushioning to its neutral position after end-of-car impacts to which the railway car may be subjected. The plate 13 also is provided with a filler plate designated at 15. The striker housing and assembly is generally designated at 16 and includes a top wall 17 and a lower wall 18. The top wall 17 is provided with wear plates 19 and wear plates 20 are connected to the outer edges of the lower wall 18 as best shown in FIG. 3. The housing 16 also includes vertical side walls 21 and 22 suitably connected to the walls 17 and 18. The side walls 21 and 22 respectively include diverging wall portions 23 and 24 to provide a bell-shaped type of mouth at the end of the housing 16. A vertical striker plate 25 is rigidly connected to the ends of the sides and top and bottom wall and includes an opening 26 provided a its lower end with coupler carrier plates generally designated at 27. The carrier plates 27 support a typical and conventional railway coupler 28 which is provided with a coupler head (not shown) of conventional form. The coupler 28 also includes a coupler shank 29 provided at its rearmost end with an elongated slot 30. As best shown in FIG. 2 the slot 30 is formed by a front laterally extending wall 31 and a rear laterally extending wall 32.

Figure 1:
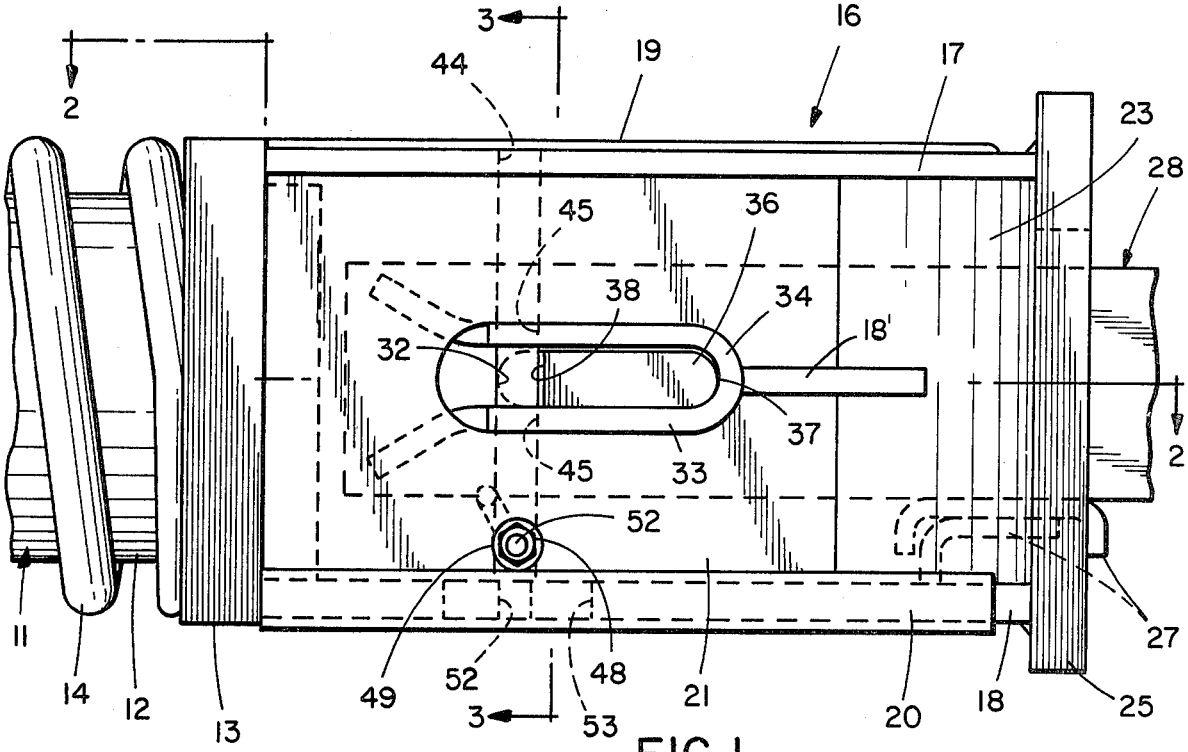
FIG. 1 is a side elevational view of a striker housing connected to a portion of a draft gear or cushioning unit.

A key supporting slot 33 is provided in each of the side walls 21 and 22 and has rigidly or fixedly secured therein U-shaped liners or liner elements 34 having load spreading horizontal portions or top and bottom legs rear edges 34' as best shown in FIG. 1 extending inwardly and having connected thereto inner flared projections or wings 35. The projections 35 are rigidly secured to the inner surfaces of the vertical side walls 21 and 22. FIG. 1 particularly discloses the flared configuration of the projections 35 and the stress distributing horizontal portion 18' extending forwardly from the closed end of the U-shaped liner and rigidly connected to the side of the related side wall 21 or 22. The flared end portions 35 are horizontally tapered and the liners 34 integrally connected to the adjacent side walls.

A draft key is designated at 36 and includes a front curved or arcuate wall 37 and a rear curved or arcuate wall 38. The rear end of the draft key 36 is machined out to provide notches or locking corners 39 spaced at the ends of the rear wall 32 and formed in arcuate configurations terminating in short vertical straight off-set walls 40. The rear wall 32 of the coupler slot 30 at its ends provides a fulcrum point A which as shown in FIG. 2 during swinging movement of the coupler shank to the dotted line position forms a fulcrum pivot on projecting ends of the rear wall 38 of the draft key 36.

As best shown in FIG. 3 a relatively short vertical retainer or locking pin 41 is rigidly secured within openings 42 provided in the U-shaped liners 34. The locking pin 41 thus is fixed and is disposed within the notch 39 on one side of the draft key 36. A removable retainer or locking pin 43 also best shown in FIG. 3 may be inserted through an access opening 44 provided in the top wall 17 downwardly through openings 45 provided in the other U-shaped liner 34 and is seated at its lower end on the lower wall 18. The retainer pin 43 also is disposed in the other notch 39 of the draft key 36 as best shown in FIG. 3 the removable retainer pin 43 is provided at its lower end with a lateral extending bore 46 which is secured by means of a J-shaped bolt 47 which is inserted through access opening 53 provided in the bottom wall 18 and tightly secured by means of a nut 58 within an access opening 49 provided in the vertical wall as shown in FIG. 1.

OPERATION

The operation of the cushioning device 11 is conventional in that impacts at the end of the car are transmitted through the coupler shank to the base plate 13 the same being dissipated by means of the cushioning unit 11. In the event that a coupler is to be replaced it is a simple matter for the mechanic to loosen up the nut 48 of the J-bolt 47 to disengage the J-bolt sideways so that the pin 43 can then be withdrawn through the opening 44 of the top wall of the housing. In order to push the pin 43 upwardly it is a simple matter for the mechanic to insert a suitable tool through a lower vertical access opening 52. He then can slide the draft key 36 outwardly through the key slot liner which is positioned on the vertical side wall 21.

As shown in FIG. 2, the key slot liner 34 has a pair of raised fulcrum projections B provided at the juncture of converging walls 50 and 51 provided at said liners.

These raised fulrum projections B are provided at a position to the rear of the coupler key slot. As the coupler angles with the car going around curves the location of this raised projection causes the coupler to angle about a center at the rear coupler key slot. Therefore, unlike the prior art there is no levering action on the key tending to force the key sideways. In the prior art existing design the conventional coupler shank is provided with a raised projection which was centered along a center line of the elongated slot of the conventional coupler. In this prior art, as the coupler angled under a pulling force, the raised projection of the conventional coupler would dig into the key and force the key laterally off-center. Thus with the conventional design unequal bearing forces and stresses would occur which greatly accentuated the over-stressed condition of the conventional key and therefore provided for premature failure. In the present improved design as the coupler shank angles about the fulcrum A and by virtue of the raised fulcrum projections B of the key slot liners there is no tendency for the key to shift laterally. Thus in the present design less frequency of key repair and replacement is required.

It is also of decided advantage to flare the ends of the key slot liners in the manner indicated in order to distribute stresses due to draft forces more equally. As the draft key bears on the curved front of the key slot liners during heavy train pulling forces, the side walls of the striker housing must transmit these forces to the base plate of the cushion. By flaring the key slot ends and wings outwardly the stresses are better distributed and longer life in the structure is effected.

As indicated heretofore the conventional structures for locking the key slot liner in position have made for great difficulties and replacement. The prior art designs wherein the draft key was held in position by means of a plate at one end and another plate which is bolted to the side walls of the housing at the other end thread damage in the threaded holes made repair very difficult. Also in this type of arrangement the key retaining plates of the prior art would subtract from the available width and thus insufficient bearing area would be provided for the draft key at the ends of the key slot liners. In the present improved design the key is retained by the two pins. The notches in the key in this design enable the key to be firmly retained against lateral movement while allowing the maximum possible length of key to carry the coupler draft loads therefore minimizing unit bearing stresses. The key therefore also will occupy the full width available without using up space for retention means which in the prior art consist of the plates above discussed.

The foregoing description and drawings merely explain and illustrate the invention and the invention is not limited thereto except insofar as the appendant claims are so limited, as those skilled in the art who have the disclosure before them will be able to make modifications and variations therein without departing from the scope of the invention.

What is claimed is:

1. In a railroad car having a center sill including a cushioning device supported within said center sill, the improvement of a striker assembly connected to said cushioning device and comprising;

a housing having spaced upright vertical walls, a top horizontal wall and a lower horizontal wall connected to said vertical walls, said vertical walls having outwardly diverging end wall portions, a vertical transverse striker plate connected to said wall portions and said top and lower walls, said striker plate having an enlarged opening including a lower ledge providing coupler carrier means, a coupler supported on said carrier means including a coupler shank having an elongated slot, said vertical walls having key supporting slots substantially relatively aligned with said shank slot, key slot liners supported within said key slots, said key slot liners having a generally U-shaped configuration with flared end portions extending inside the housing rigidly connected to the vertical walls and a horizontal portion extending forward from the closed end of the U-shaped key slot liner for spreading loads over extensive areas of the sidewalls; and retainer pin means removably securing the key within the slots, extending through the key slot liners and engaging the key for resisting coupler buffeting loads.

2. In a railroad car having a center sill including a cushioning device supported within said center sill, the improvement of a striker assembly connected to said cushioning device and comprising;

a housing having spaced upright vertical walls, a top horizontal wall and a lower horizontal wall connected to said vertical walls, said vertical walls having outwardly diverging end wall portions, a vertical transverse striker plate connected to said wall portions and said top and lower walls, said striker plate having an enlarged opening including a lower ledge providing coupler carrier means, a coupler supported on said carrier means including a coupler shank having an elongated slot, said vertical walls having key supporting slots substantially relatively aligned with said shank slot, key slot liners supported within said key slots, a key extending transversely through said slots and being supported on said key slot liners, and means removably supporting said key within said slots including vertical pin means connected to said housing and fixedly engaging said key to secure the same against movement, said vertical pin means including a pair of vertical retainer pins, means supporting one of said retainer pins on said housing, means removably supporting said other retainer pin on said housing relative to said key, said top wall having an access opening through which said removable pin may be inserted and removed, and lock means removably connected to said removable retainer pin, for locking said removable retainer in one retaining position, and access means provided in one of said vertical walls providing for access to said locking means.

3. For a striker assembly, a housing comprising side walls with transverse elongated horizontal key slots therein, stress distributing means fixed to said walls about respective slots, each of said stress distributing means comprising:

a generally U-shaped liner element fitted into respective slots having top and bottom legs defining the upper and lower edges of the respective slot, and each liner having rearwardly vertically diverging and horizontally tapered end portions on said legs positioned on the internal side of the respective side wall and extending beyond the respective slot and integrally connected to the adjacent side wall for transferring loads thereto.

4. The invention according to claim 3, and a T-shaped coupler securing draft key means having end portions extending into respective slots and having an intermediate rearwardly extending portion forming rearwardly-facing locking corners, and means for locking said key means to said housing located inwardly of respective sidewalls and flanking said intermediate portion of the key means and extending vertically within the respective corners through respective liner elements.

5. The invention according to claim 3, and a draft key extending through the key slots retaining a coupler subject to angling motion, each of said liner elements on the housing comprising means providing fulcrums behind the draft key for the coupler accommodating said angling motion thereof, and pin means cooperative with said draft key and said liner elements for inhibiting lateral shifting of the key.

6. The invention according to claim 5, wherein each of said liner elements projecting within the housing, and horizontal stress distributing means external of the housing connected to said liner elements and projecting forwardly therefrom and integral with the housing.

7. For a striker assembly, a housing comprising side walls with transverse elongated horizontal key slots therein, stress distributing means fixed to said walls about respective slots, each of said stress distributing means comprising:

a generally U-shaped liner element fitted into respective slots having top and bottom legs defining the upper and lower edges of the respective slot, each liner having diverging flared end portions on said legs positioned on the internal side of the respective wall and extending beyond the respective slot and secured to the adjacent wall for transferring loads thereto, each of said U-shaped liners having vertically aligned openings in the top and bottom legs, inwardly of said side walls, and retainer means extending through respective openings for removably holding the key within the slots and providing a bearing surface for the key when the coupler is subjected to longitudinally inward buffeting loads.

* * * * *